US006564406B2

(12) United States Patent
VanSteenburg et al.

(10) Patent No.: US 6,564,406 B2
(45) Date of Patent: May 20, 2003

(54) SHOULDER SURGERY ATTACHMENT FOR A SURGICAL TABLE

(75) Inventors: Kip P. VanSteenburg, Sudbury, MA (US); Paul A. Licari, Boxborough, MA (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 09/814,918

(22) Filed: Mar. 22, 2001

(65) Prior Publication Data

US 2001/0032364 A1 Oct. 25, 2001

Related U.S. Application Data

(60) Provisional application No. 60/192,556, filed on Mar. 28, 2000.

(51) Int. Cl.[7] ..... A47C 20/04

(52) U.S. Cl. ..... 5/621; 5/633; 5/634; 5/635

(58) Field of Search ..... 5/621, 617, 622, 5/633, 634, 635; 128/845; 606/242, 244

(56) References Cited

U.S. PATENT DOCUMENTS 5,661,859 A 9/1997 Schaefer
5,926,876 A * 7/1999 Haigh et al. ..... 5/616
6,023,800 A * 2/2000 Stickley ..... 248/229.26

OTHER PUBLICATIONS

Allen Medical Systems, "Passionate about Positioning" brochure, pp. 1–20, 1998.

O.R. Direct Surgical Table Accessories, Fall 1999 catalog, pp. 1–24.

* cited by examiner

*Primary Examiner*—Anthony Knight
*Assistant Examiner*—Fredrick Conley
(74) *Attorney, Agent, or Firm*—Barnes & Thornburg

(57) ABSTRACT

A surgical table has an articulated leg section with accessory attachment rails on opposite sides thereof. A shoulder surgery attachment for the surgical table includes a chair back assembly having a base on one end thereof and a cooperating second connector at each of its sides. Each second connector is releasably attachable to its corresponding first connector. A pair of mounting blades are provided on opposite sides of the base. A rail clamp is positionable along the attachment rails to be fastened to each of the attachment rails to provide a first connector at each side of the leg section.

30 Claims, 6 Drawing Sheets

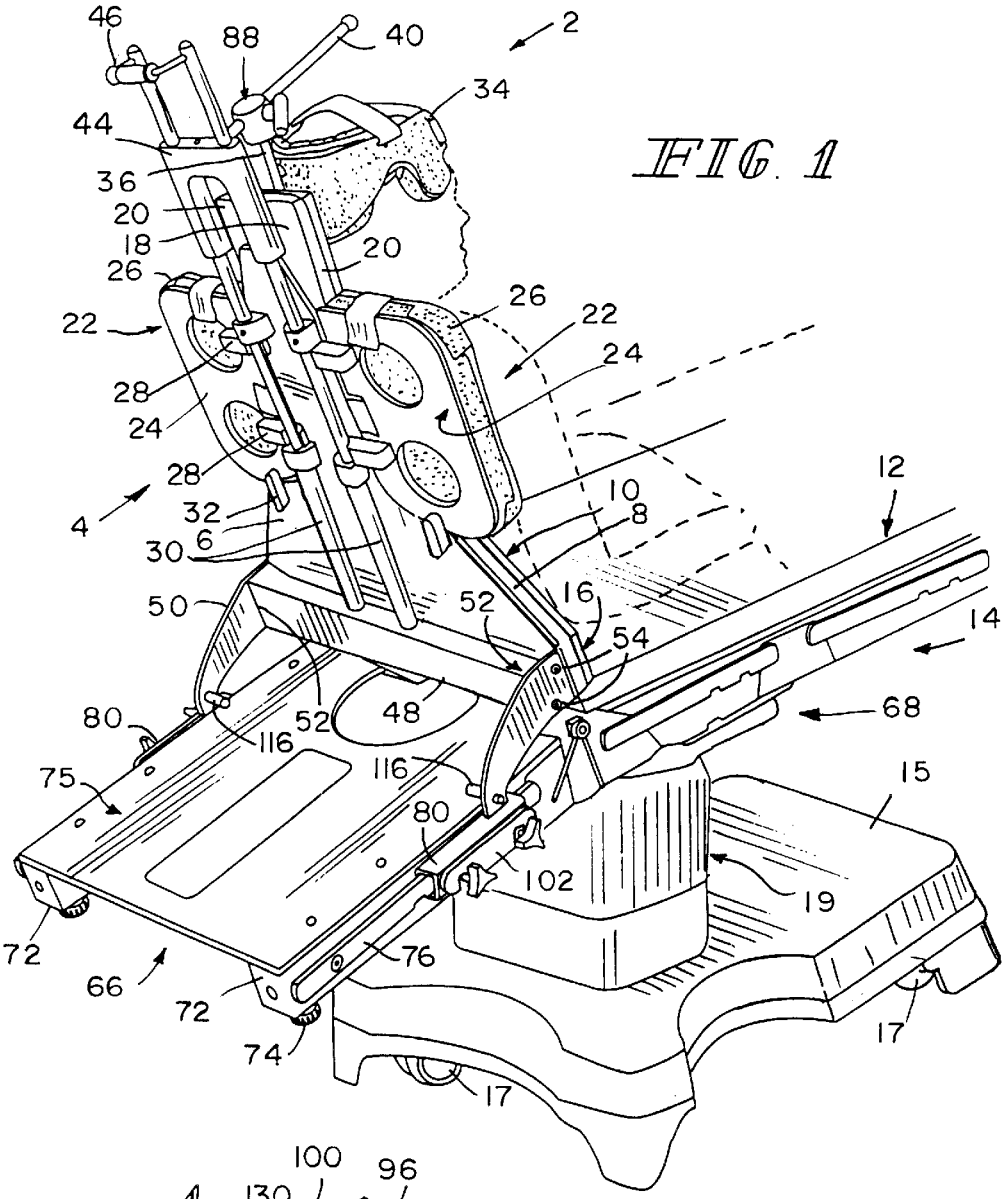
FIG. 1
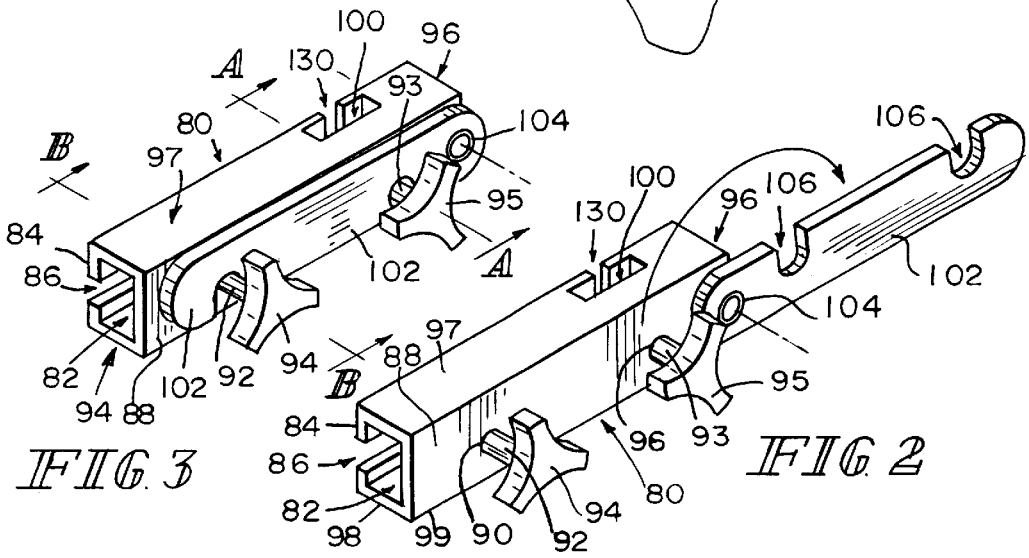
FIG. 3
FIG. 2

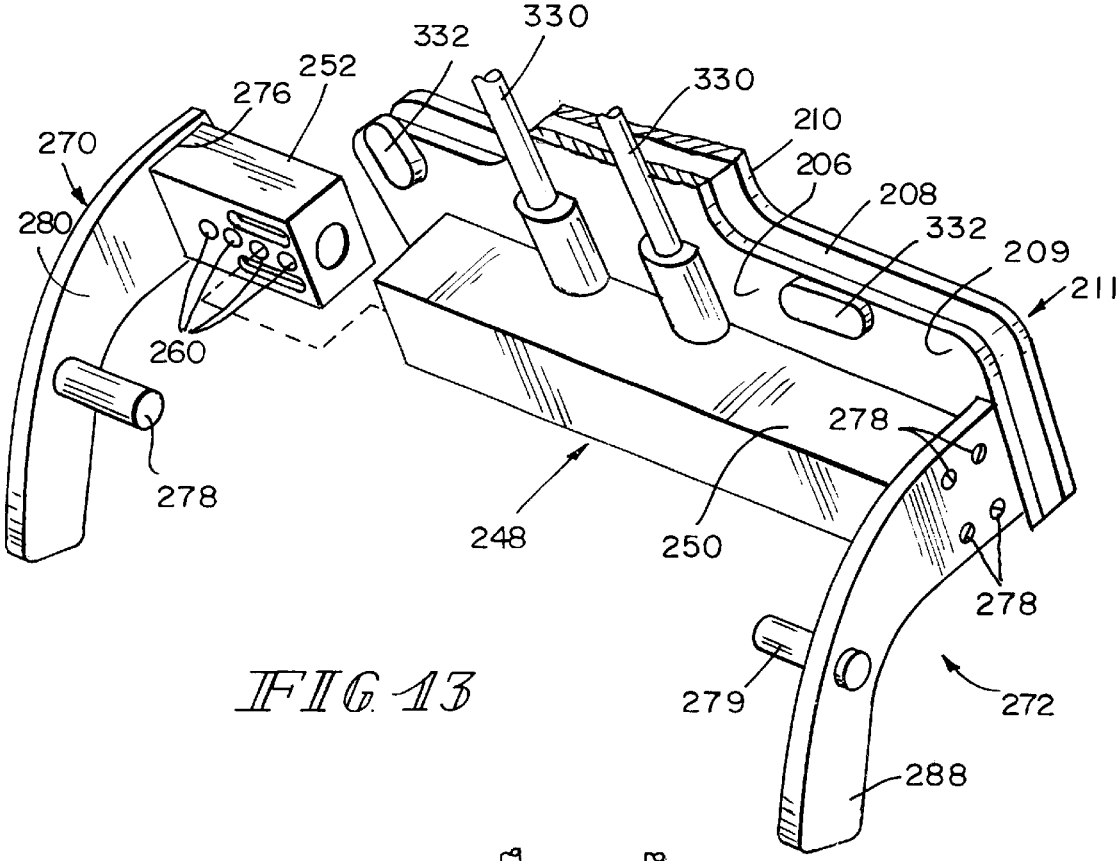
FIG. 13
FIG. 14
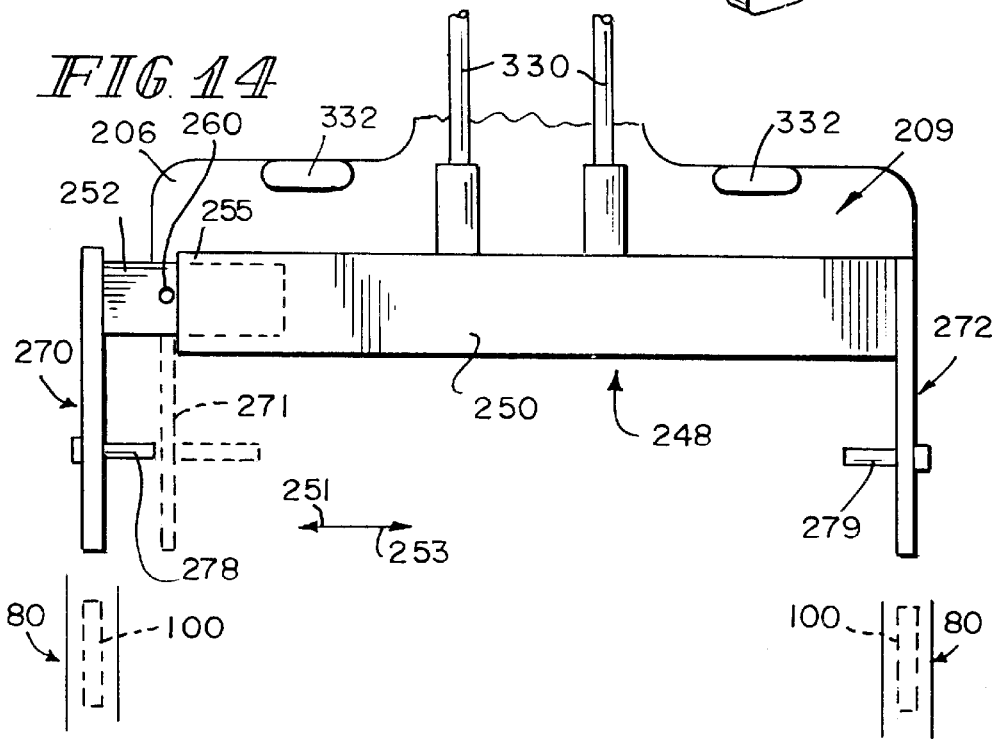

SHOULDER SURGERY ATTACHMENT FOR A SURGICAL TABLE

RELATED APPLICATIONS

This application is based upon U.S. Provisional Application Ser. No. 60/192,556 filed on Mar. 28, 2000, the complete disclosures of which are hereby expressly incorporated herein by this reference thereto.

BACKGROUND AND SUMMARY

The present invention relates to surgical attachments for positioning a patient for surgical procedures and particularly to a shoulder surgery attachment for a surgical table.

Surgical procedures on the shoulders of patients are often performed with the patients in the so called beach-chair position. In the beach-chair position, a patient is positioned in a sitting position during surgery, although the patient may be anesthetized in a supine position.

There are presently several devices that are used for positioning patients in the beach-chair position, such as dedicated surgical tables that are factory-made with the required mechanisms, and such as accessories for regular tables that adapt them for positioning patients in the beach-chair position. U.S. Pat. No. 5,661,859 to Schaefer discloses a shoulder arthroscopy attachment for use with a surgical table wherein the attachment may be attached to a seat section of the table in place of an articulated leg section. U.S. Pat. No. 5,926,876 to Haigh et al. discloses a device for adapting a surgical operating table so that the upper torso of a patient can be raised in order to place the patient in a seated position. The device shown in the '876 patent is positioned on a horizontal surface and is pivotal with respect to the horizontal surface. Both the '859 and '876 patents are hereby incorporated herein by reference to establish the background for the present application.

An embodiment illustrated herein provides a shoulder surgery attachment that can be coupled to an articulated leg section of a surgical table. The attachment couples to the accessory rails of the table so that the mechanism used to move the articulated leg section of the table is used to move the shoulder surgery attachment into desired positions.

The illustrative embodiment provides a shoulder surgery attachment comprising a rail clamp providing a first connector at each side of the articulated leg section. A chair back assembly is included having a cooperating second connector releasably attachable to each corresponding first connector. The chair back assembly is selectively adjustable with the leg section. To position the attachment, a gage may be provided to space the rail clamps relative to the pivot axis of the leg section.

In the illustrative embodiment, the shoulder surgery attachment includes a backboard having a base positioned on one end thereof. First and second mounting blades are attached to the base. A pair of rail clamps are provided, each including an opening configured to receive one of the mounting blades. One illustrative base is provided for coupling the shoulder surgery attachment to surgical tables of different widths, the base including an adjustable or extending member carrying one of the blades.

In an illustrative embodiment, the shoulder surgery attachment may provide a backboard having a broad lower portion for attachment to the base, and a narrow upper portion for support of a patient's back. The upper portion is configured not to obstruct the positioning of the patient's arm rearward of a plane defined by the patient's back.

In an illustrative embodiment, the first and second mounting blades each include a support portion and an angularly-spaced blade portion. Each support portion is attached to either the base or the extending member. Each angularly-spaced blade portion is received in the opening of its associated rail clamp. The angularly-spaced blades may be angled relative to the backboard to provide a mechanical advantage when positioning an obese patient.

Additional features and advantages of the shoulder surgery attachment will become apparent to those skilled in the art upon consideration of the following descriptions.

BRIEF DESCRIPTION OF DRAWINGS

The illustrative embodiments will be described hereinafter with reference to the attached drawings which are given as non-limiting examples only, in which:

FIG. 1 is a perspective rear view of a surgical table with one embodiment of the shoulder surgery attachment coupled to the articulated leg section of the surgical table;

FIG. 2 is a perspective view of a rail clamp with a height gage used to couple the shoulder surgery attachment to the accessory attachment rail of the articulated leg section of the surgical table;

FIG. 3 is a perspective view of the rail clamp of FIG. 2 with the height gage in a closed position;

FIG. 13 is a perspective view of a telescoping brace of the shoulder surgery attachment of FIG. 11;

FIG. 14 is a rear view of the telescoping brace of FIG. 11; and

Corresponding reference characters indicate corresponding parts throughout the several views. The exemplification set out herein illustrates the embodiment of the attachment, in several forms, and such exemplification is not to be construed as limiting the scope of the attachment, in any manner.

DETAILED DESCRIPTION OF THE DRAWINGS

Figure 4:
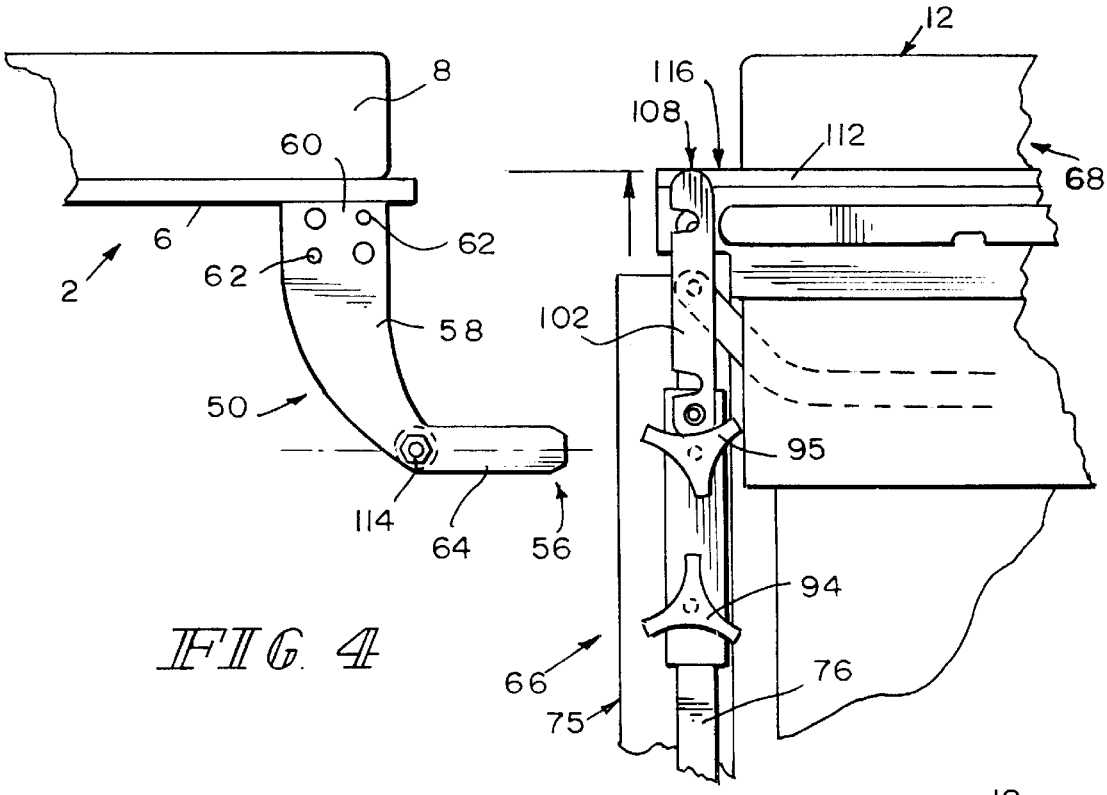
FIG. 4 depicts the manner in which the height gage is pivoted about a forward end of the rail clamp and used to position the rail clamp along the accessory attachment rail of the articulated leg section of a surgical table.

A shoulder surgery attachment system 2 includes a shoulder chair back assembly 4 having a backboard 6 and a back cushion 8 that provides a patient support surface 10. As depicted in FIG. 1, the backboard 6 and the back cushion 8 each have a base width that is substantially equal to the width of the patient support surface 12 of the adjoining surgical table 14 in FIG. 1. The width of the backboard 6 and back cushion 8 each taper symmetrically upward starting at a small distance from the base 16 to a central portion 18 having parallel sides 20.

The shoulder chair back assembly 4 includes removable shoulder panels 22 that are attachable to the parallel sides 20 of the central portion 18 of the backboard 6. The shoulder panels 22 include planar support bases 24 and shoulder cushions 26. The shoulder panels 22 are coupled to the removable backboard 6 by coupling arms 28 that are attached to the support bases 24 adjacent inner edges thereof. The coupling arms 28 include cylindrical recesses configured to receive parallel support tubes 30 that are fixed to the back of the backboard 6 along the central portion 18 as shown in FIG. 1. The shoulder panels 22 are adjustable about the parallel support tubes 30. The shoulder panels 22 are positioned and pivoted latches 32 are used to hold the shoulder panels 22 in the position shown in FIG. 1.

The shoulder surgery attachment system 2 includes a headrest 34 that is coupled by a support rod 36 to ball joint assembly 38. Ball joint assembly 38 is supported by rod 40 that is coupled to a slide assembly 44 which receives parallel support tubes 30. A handle 46 is used to extend and retract tubes 30 to provide further access to the patient's head. In addition to the shoulder panels 22 and headrest 34, the shoulder surgery attachment system 2 can include other optional attachments, including removable arm supports, lateral braces, etc.

The base 16 of the backboard 6 includes rectangular brace 48 that extends across the width thereof and receives and supports the ends of parallel support tubes 30. Shoulder positioner mount blades 50 are attached to ends 52 of the rectangular brace 48 by threaded mechanical fasteners 54.

Figure 5:
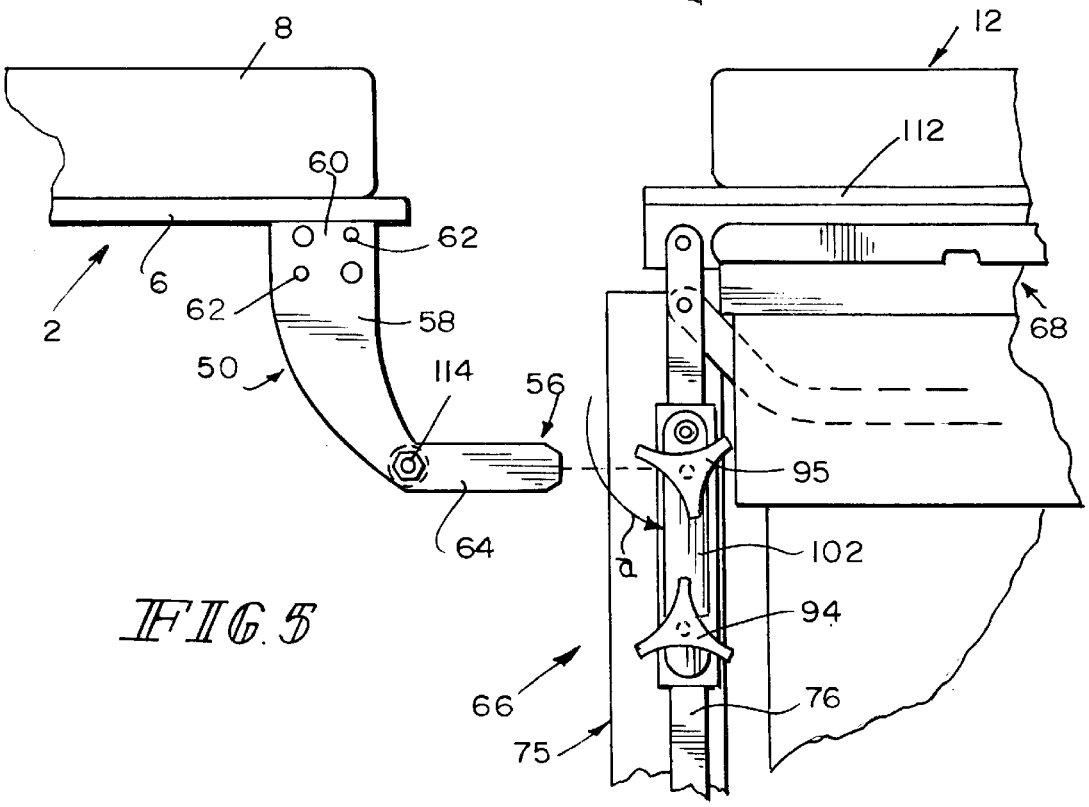
FIG. 5 depicts the manner in which the rail clamp is positioned along the accessory attachment rail of the articulated leg section of a surgical table and the alignment of a shoulder positioner mount blade with respect the mounting slots of the rail clamp.

The free ends 56 of the shoulder positioner mount blades 50 are shown best in FIG. 4 and 5 and are rectangular in shape. Each of the shoulder positioner mount blades 50 generally includes a curved portion 58 having a wider end 60 that includes apertures 62 through which threaded fasteners 54 pass to secure the shoulder positioner mount blade 50 to the adjacent end 52 of the rectangular brace 48 and a rectangular portion 64 which is configured to be received in mounting slots 100 provided in the rail clamps 80.

FIG. 1 depicts the shoulder surgery attachment system 2 coupled to the articulated leg section 66 of a surgical table 14. The surgical table 14 includes an articulated leg section 66 and a seat section 68 to which the articulated leg section 66 is pivotally coupled. The surgical table can also include an articulated head section (not shown) upon which the patient depicted in phantom lines in FIG. 1 would rest his or her legs. FIG. 1 also shows the surgical table 14 as including a base 15 with casters 17 and an intermediate frame or pedestal 19.

The articulated leg section 66 of the surgical table 14 includes an articulated frame 72 and deck 75 that normally supports a leg section cushion that has been removed in FIG. 1. Accessory attachment rails 76 are mounted to the articulated leg section 66 at sides 74 thereof by braces (not shown) that cause the accessory attachment rails 76 to be spaced apart from the sides 74 of the articulated frame 72.

Rail clamps 80 are coupled to the accessory attachment rails 76 in FIG. 1 and are used to couple the shoulder positioner mount blades 50 to the articulated leg section 66 for pivotal movement therewith with respect to the seat section 68.

As shown in FIGS. 2 and 3, the rail clamps 80 are elongate members having a central channel 82 therethrough and an inner side wall 84 that includes an open slot 86 that extends along the length of the elongate members. The central channel 82 of the rail clamps 80 is configured to receive the accessory attachment rails 76 of the articulated leg section 66 so that the rail clamps 80 can freely slide along the accessory attachment rails 76. The open slot 86 formed in the inner side wall 84 of the rail clamps 80 allows the rail clamps 80 to slide past the brackets 81 which secure the accessory attachment rails 76 to the articulated frame 72.

The outer side wall 88 of the rail clamps 80 is provided with two internally threaded through-holes 90 which receive threaded fasteners 92 and 93 having hand knobs 94 and 95. The internally threaded holes 90 are positioned toward the front and rear ends 96 and 98 of the rail clamps 80 as shown. The rail clamps 80 are provided with mounting slots 100 in an upper and lower walls 97 and 99 thereof near the forward end 96 thereof. Mounting slots 100 are configured to receive the rectangular portions 64 of the shoulder positioner mount blades 50. In addition, a notch 130 is disposed into each mounting slot 100 to assist manufacturer in forming same.

The rail clamps 80 are provided with height gages 102. The height gages 102 are flat elongate members that are pivotally coupled to the outer side wall 88 of the rail clamps 80 at the forward ends 96 thereof by pivot pins 104. FIG. 2 depicts height gage 102 extending outward from the forward end 96 of the rail clamp 80. As seen, the height gage 102 includes two notches 106 that are configured and positioned to be aligned with threaded fasteners 92 and 93. The notches 106 allow the height gage 102 to be pivoted into the closed position depicted in FIG. 3.

Figure 6:
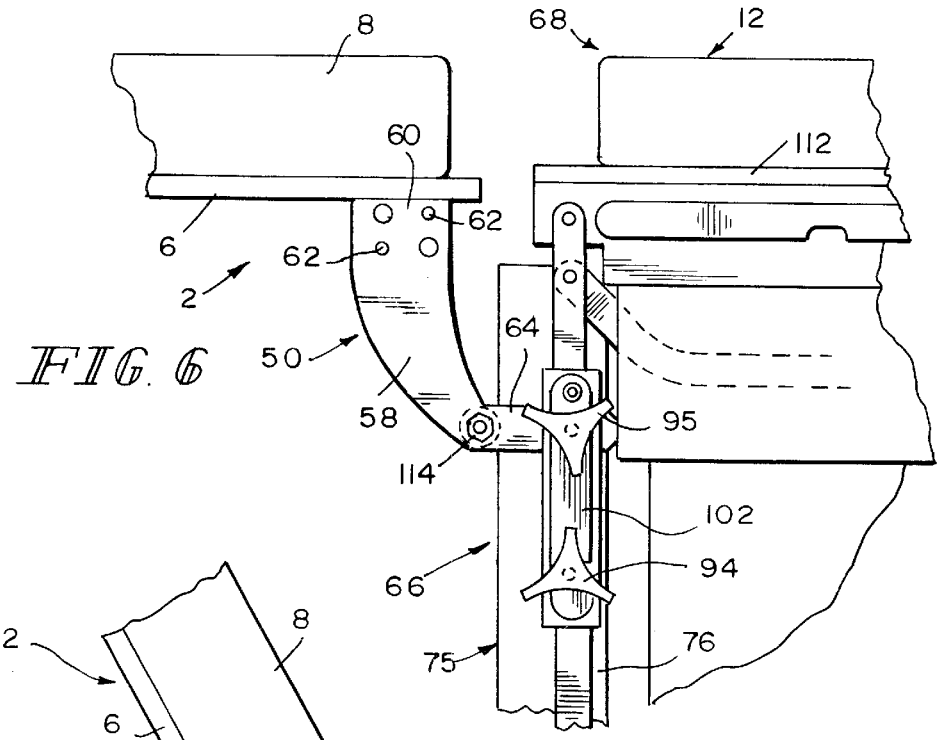
FIG. 6 depicts the shoulder positioner mount blade fully inserted into and through the mounting slots of the rail clamp.

FIGS. 4–6 progressively depict how the shoulder surgery attachment 2 is coupled to the articulated leg section 66 of a surgical table 14. First, the leg section cushion is removed from the articulated leg section 66 and the articulated leg section 66 is pivoted so as to be aligned at 90° with respect to the seat section 68 of the surgical table 14. Next, rail clamps 80 are slid along the accessory attachment rails 76 on the sides of the articulated leg section 66. The rail clamps 80 are positioned on the accessory attachment rails 76 with the forward ends 96 thereof facing the seat section 68 of the surgical table 14. The height gage 102 is extended forward as depicted in FIG. 4 (also see FIG. 2). The height gage 102 is used to properly position the rail clamps 80 on the accessory attachment rails 67. In this regard, it can be appreciated from viewing the illustrative figures that the pivot point of the shoulder surgery attachment 2 should be properly aligned in order for the shoulder surgery attachment 2 to pivot with respect to the seat section 68 as the leg section 66 is articulated. The pivot point of the shoulder surgery attachment 2 is offset from the shoulder back assembly 4 and determined by where the shoulder positioner mount blades 50 are mounted to the articulated leg section 66, i.e., the position of rail clamps 80 on accessory attachment rails 76.

The rail clamps 80 are properly positioned on the accessory attachment rails 76 using the height gages 102 as depicted in FIG. 4. As shown, with the height gages 102 positioned to extend forward of the rail clamps 80, the rail clamps 80 are positioned on the accessory attachment rails 76 at a position in which the free ends 108 of the height gages 102 are lined up with the top surface 110 of the seat section deck 112.

When the height gages 102 are aligned with the seat section deck 112 as shown in FIG. 4, threaded fastener 92 is tightened by turning knob 94 so that the end of fastener 92 that is inside central channel 82 of rail clamp 80 tightens against accessory attachment rail 76. In this manner, threaded fastener 92 holds rail clamp 80 in its properly aligned position.

Next, the height gage 102 is pivoted to its closed position as indicated by arrow "a" in FIG. 5 and the rectangular portions 64 of the shoulder positioner mount blades 50 are inserted into mounting slots 100 of the rail clamps 80. The shoulder positioner mounting blades 50 are provided with stops 114 at the junction between the rectangular portions 64 and the curved portions 58. The stops 114 comprises pins or bolts 116 that extend from inner surfaces of the shoulder positioner mount blades 50 (see FIG. 1). The rectangular portions 64 of the shoulder positioner mount blades 50 are inserted into and through the mounting slots 100 until stops 114 abut against the upper surface of deck 75 of articulated foot section 66. Threaded fastener 93 is then tightened by turning knob 95.

Figure 7:
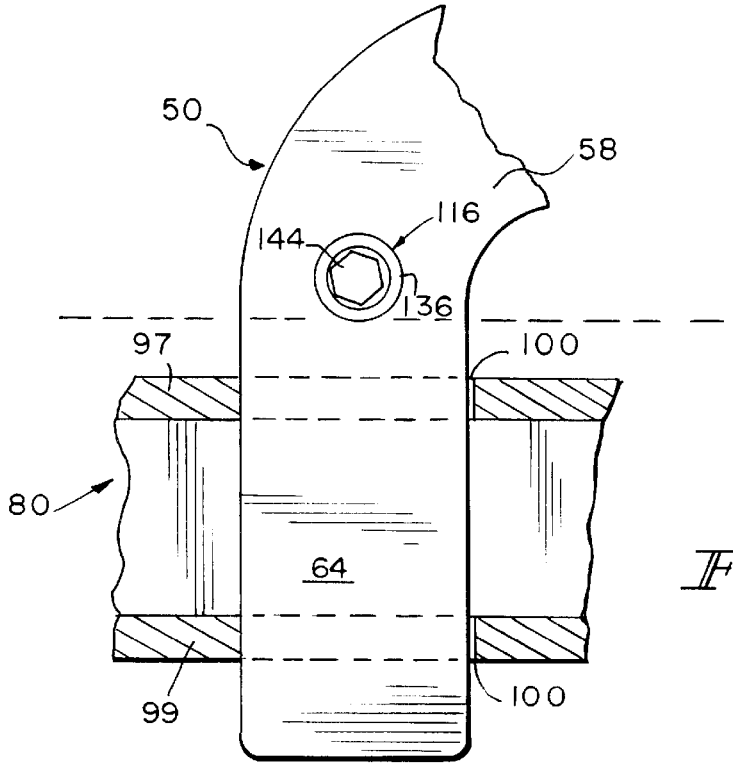
FIG. 7 is a sectional view of a rail clamp with an end of a shoulder positioner mount blade inserted through the mounting slots in the rail clamp.

As shown in FIG. 7, the mounting slots 100 in the upper 97 and lower 99 walls of the rail clamps 80 are aligned and have lengths that provide little clearance for receiving the rectangular ends 64 of the shoulder positioner mounting blades 50. The configuration helps ensure proper positioning and alignment when the shoulder chair back assembly 4 is coupled to the articulated leg section 66 of a surgical table 14. In addition, bolt 116 comprises a hex nut 144 surrounded by a vinyl cap 136. (See also FIG. 9.)

Figure 8:
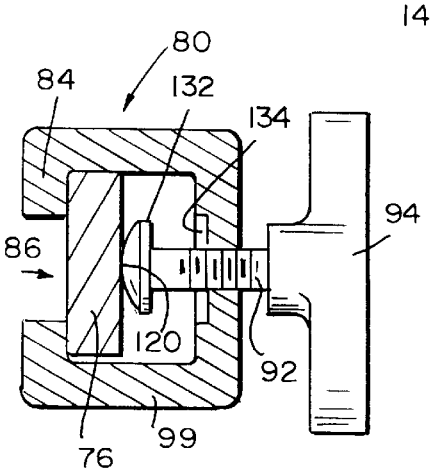
FIG. 8 is a sectional view of the rail clamp taken along section lines B—B in FIG. 3 depicting how a treaded fastener tightens against an accessory attachment rail.

FIG. 8 depicts how the rounded head 120 of threaded fastener 92 of a rail clamp 80 tightens against an accessory attachment rail 76 once the rail clamp 80 is properly positioned as shown in FIG. 4. A nylon washer 132 is provided on a rounded head 120 corresponding to countersink 134 configured to receive washer 132 when rounded head 120 doesn't engage rail 76.

Figure 9:
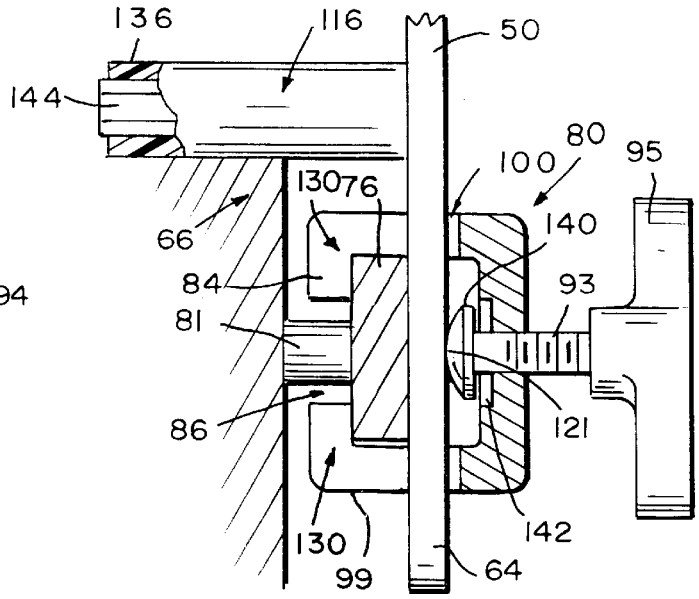
FIG. 9 is a sectional view of the rail clamp taken along section lines A—A in FIG. 3 depicting how a threaded fastener tightens against the rectangular portion of a shoulder positioner mounting blade extending through the mounting slots in the rail clamp.

FIG. 9 depicts how the rounded head 121 of threaded fastener 93 of a rail clamp 80 tightens against the rectangular portion 64 of a shoulder positioner mounting blade 50 which in turn is forced to tighten against accessory attachment rail 76. FIG. 9 also shows that the width of mounting slots 100 provide sufficient clearance so that, as threaded fastener 93 is tightened against the rectangular portion 64 of shoulder positioner mounting blade 50, the rectangular portion 64 of shoulder positioner mounting blade 50 can move across the width of the mounting slot 100 into contact with the accessory attachment rail 76. As similarly shown in FIG. 8, FIG. 9 also shows a nylon washer 140 is provided on rounded head 121 corresponding to countersink 142 configured to receive washer 140 when rounded head 121 does not engage rail 76. It will be appreciated that other types of releases and connectors, beyond the rail clamps 80 with slots 100 for receiving positioner mount blades 50 as shown, are contemplated in this application. It is further contemplated to provide a first connector on a rail clamp at each side of the table, and a mating connector on each side of the attachment to be releasably connected to the first connector.

Figure 10:
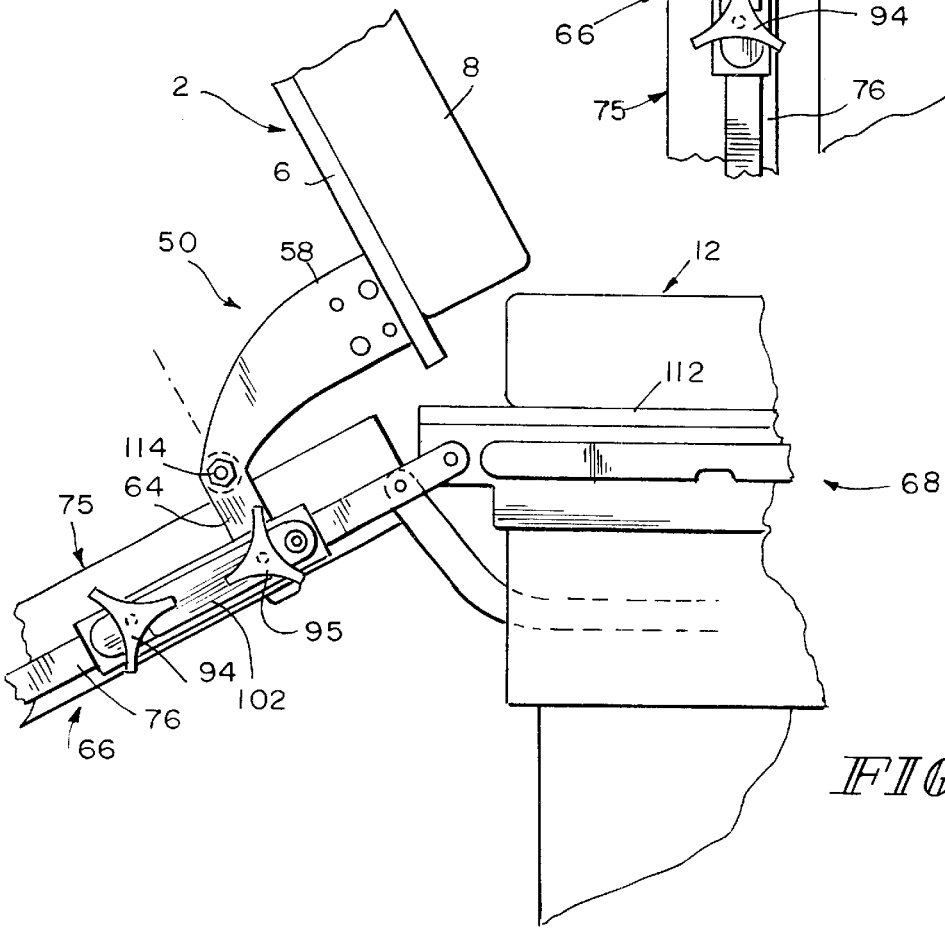
FIG. 10 depicts the manner in which the shoulder surgery attachment system of the present application is pivotable together with the articulated leg section of the surgical table.

Once the shoulder surgery attachment system 2 of the present application is coupled to the articulated leg section 66 of a surgical table 14, the mechanism which articulates the articulated leg section 66 can be operated. As the articulated leg section 66 pivots with respect to seat section 68, the shoulder surgery attachment system 2 also pivots with respect to the seat section 68, as depicted in FIG. 10. Because the shoulder surgery attachment system 2 is coupled to the articulated leg section 66 at a 90° angle, the shoulder surgery attachment system 2 has a pivotal range of motion that extends between a vertical position and a horizontal position. Thus, even though the shoulder surgery attachment system 2 is coupled to the articulated leg section 66 of a surgical table 14, it is possible, according to the present application, to position the shoulder back assembly 4 to a horizontal position in which it will be level with the seat section 68 of a surgical table 14. Such positioning is not possible with some known shoulder surgery attachment apparatus.

Figure 11:
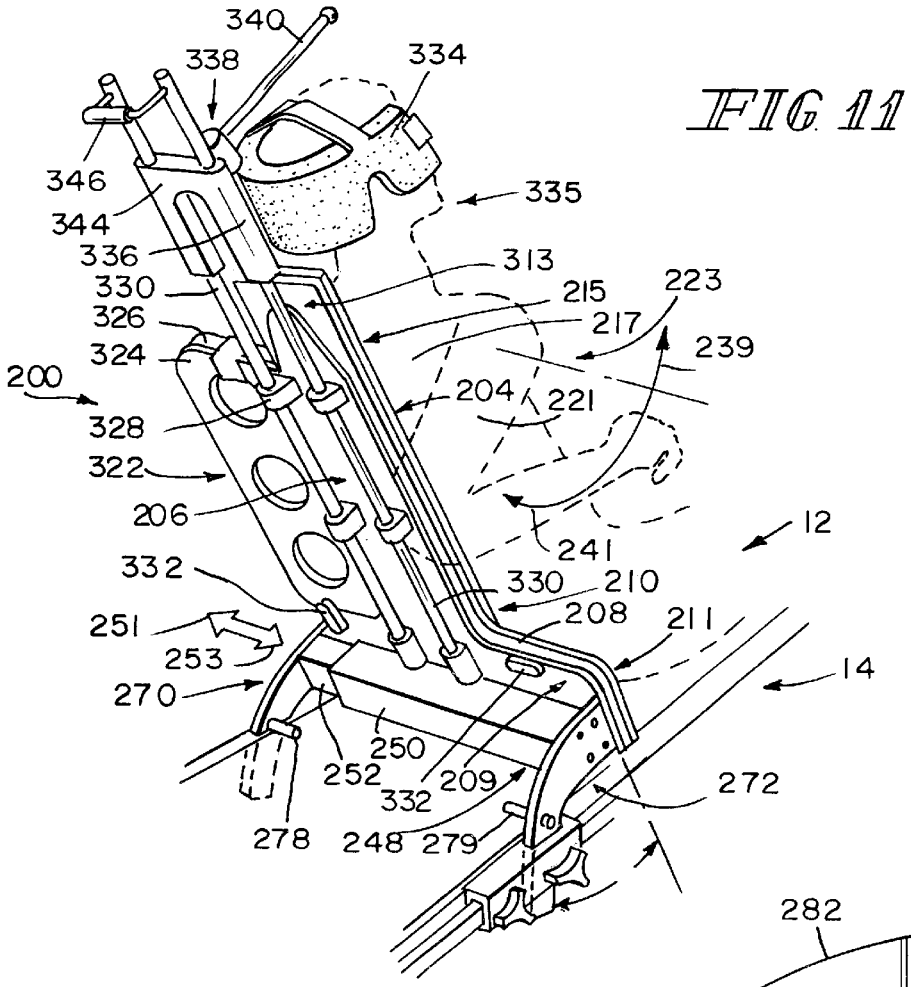
FIG. 11 is a perspective rear view of the surgical table with another embodiment of the shoulder surgery attachment also coupled to the articulated leg section of the surgical table.
Figure 12:
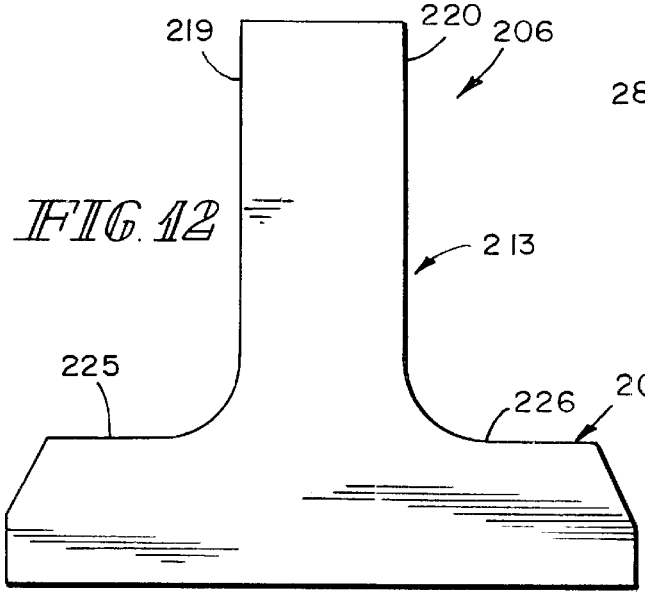
FIG. 12 is a view of the backboard portion of the shoulder surgery attachment of FIG. 11.

Another embodiment of the shoulder surgery attachment system, indicated by reference numeral 200, is shown in FIG. 11. Shoulder surgery attachment system 200 id includes a shoulder chair back assembly 204 having a backboard 206 and a back cushion 208 that provides a patient support surface 210. The backboard 206 and the back cushion 208 each have a lower portion 209, 211, having a width that is generally equal to the width of patient support surface 12 of the adjoining surgical table 14. (See also FIG. 1.) In contrast to the previous embodiment, the width of upper portions 213, 215 of backboard 206 and back cushion 208 is substantially narrower than lower portions 209, 211. For example, in one illustrative embodiment, upper portions 213, 215 have a width of about 5.6 inches, which is about four times less than lower portions 209, 211, having a width of about 23 inches. It is contemplated, however, that the width of upper portion 213 need only be sufficient to support back 217 of patient 223, and allow arm 221 to be movable in directions 239, 241, and be accessible without interference from upper portions 213, 215. As depicted in FIG. 11, arm 221 is positioned rearward of back 217. As shown in FIG. 12, sides 219, 220 extend downwardly, joining with edges 225, 226, forming backboard 206.

As in the previous embodiment, backboard 206 includes back shoulder panels 322 which include planar support bases 324 and shoulder cushions 326. The illustrated embodiment shows only one panel 322 adjacent side 219 of backrest 206, though it is appreciated that another panel can be positioned adjacent side 220. Shoulder panel 322 is coupled to backboard 206 by coupling to arms 328 that are attached to support base 324. The coupling arms 328 include cylindrical recesses configured to receive parallel support tubes 330 that are fixed to the back of backboard 206 along the upper portion 213, as shown in FIG. 11. Shoulder panel 322 is adjustable about the parallel support tubes 330. Pivot latch 332 is provided to hold shoulder panel 322 in position, as also shown in FIG. 11.

Shoulder surgery attachment system 200 also includes a headrest 334 that is coupled by a support rod 336 to ball joint assembly 338. Ball joint assembly 338 is supported by rod 340 that is coupled to a slide assembly 344 which receives parallel support tubes 330. A handle 346 is used to extend and retract tubes 330 for providing further access to the patient's head 335. In addition to shoulder panels 322 and headrest 334, the shoulder surgery attachment system 200 can include other optional attachments, including removable arm supports, lateral braces, etc.

It is contemplated that shoulder surgery attachment system 200 is configured to attach to surgical tables of varying widths. Accordingly, illustrative brace 248 is attached to the lower portion 209 of backboard 206 and includes outer and inner members 250, 252 telescoping in directions 251, 253. (See FIGS. 11 and 14.) Inner member 252 is telescopically movable within an opening 255 disposed longitudinally within member 250. (See also FIG. 14.) The member 252 is free to float within member 250 to adjust to varying table widths. Spaced apart holes 260 are disposed in the member 250 to lighten the weight of the member.

Shoulder positioner mount blades 270, 272 are attached to outer ends 274, 276 of inner and outer members 250, 252, respectively. Mechanical fasteners 278 are used to attach blades 270, 272 to ends 274, 276. As depicted in FIG. 14, inner member 252 is movable for allowing blades 270, 272 to align with slots 100 on rail clamps 80. (See broken line 271 of blade 270.) Blades 270, 272 also include pins 278, 279 that extend from inner surfaces 280, 281. Such pins 278, 279 serve as stops abutting against the upper surface of deck 75, similar to pins 116 of the previous embodiment.

Figure 15:
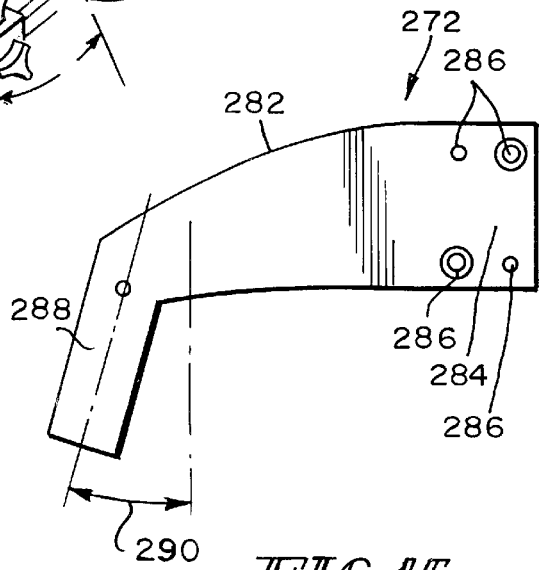
FIG. 15 is a side view of another embodiment of a shoulder positioner mount blade.

As best shown in FIG. 15, blade 272 (being similar in construction to blade 270) includes a generally curved portion 282 having a wider end 284, having apertures 286 through which fasteners 278 pass to secure blade 272 to end 276. Blade 272 also includes a rectangular portion 288 configured to be received in mounting slots 100 provided in rail clamps 80, as previously discussed. In the illustrated embodiment, rectangular portion 288 is angularly-spaced relative to a line which is parallel to the back 206 (FIGS. 11 and 12). For example, in the embodiment shown in FIG. 15, blade portion 288 is positioned at an angle of about 15° (reference numeral 290) from a reference line which is parallel to back 206. This is in contrast to blade 50, wherein rectangular portion 56 is generally parallel to the back. Rectangular portion 288, being angled as shown, provides a mechanical advantage for supporting and adjusting obese persons on either apparatus 2 or 200.

Although the present embodiments have been described with reference to particular means and materials, from the foregoing description, one skilled in the art can easily ascertain the essential characteristics of the shoulder surgery attachment, and various changes and modifications may be made to adapt the various uses and characteristics without departing from the spirit and scope of the present application, as described by the claims which follow.

What is claimed is:

1. A shoulder surgery attachment for a surgical table having an articulated leg section with accessory attachment rails on opposite sides thereof, wherein the shoulder surgery attachment comprises:

a chair back assembly having a base on one end thereof;

a pair of mounting blades fixed on opposite sides of the base; and a pair of rail clamps configured to be coupled to the accessory attachment rails of the articulated leg section for movement therewith when the articulated leg section is articulated, and the rail clamps including mounting slots configured to receive free ends of the mounting blades.

2. The shoulder surgery attachment of claim 1, wherein the mounting blades include portions that are attached to the ends of the base of the chair back assembly, and portions that are received in the mounting slots of the rail clamps.

3. The shoulder surgery attachment of claim 1, further comprising a height gage, said height gage being configured to space the rail clamps relative to the pivot axis of the articulated leg section, thereby to position the attachment.

4. The shoulder surgery attachment of claim 3, wherein the gage is coupled to one of the rail clamps.

5. The shoulder surgery attachment of claim 4, wherein the gage is pivotally coupled to one of the rail clamps.

6. The shoulder surgery attachment of claim 1, wherein each of the pair of rail clamps includes a threaded member that can be tightened to contact and secure the rail clamp.

7. The shoulder surgery attachment of claim 6, wherein each of the pair of rail clamps includes another threaded member that can be tightened to contact the mounting blade received in the mounting slot thereof.

8. The shoulder surgery attachment of claim 1, wherein the base comprises a member movable relative to the base for coupling the shoulder surgery attachment to surgical tables of different widths.

9. The shoulder surgery attachment of claim 1, wherein each of the mounting blades comprises a portion attached to the base and angularly-spaced blade portion received in the mounting slot of the associated rail clamp.

10. The shoulder surgery attachment of claim 9, wherein the chair back assembly provides a back board and wherein the angularly-spaced blade portion is disposed at an angle relative to a plane which is generally parallel to the back board.

11. The shoulder surgery attachment of claim 10, wherein the angle is approximately 15°.

12. A shoulder surgery attachment for a surgical table having an articulated leg section with accessory attachment rails on opposite sides thereof, the attachment comprising:

a rail clamp configured to be fastened to each of the attachment rails of the articulated leg section to provide a first connector at each side of the articulated leg section for movement therewith when the articulated leg section is articulated;

the rail clamps being positionable along the attachment rails; and a chair back assembly having at each of its sides a cooperating second connector fixedly coupled thereto, each second connector being releasably attachable to its corresponding first connector, whereby the chair back assembly is selectively adjustable with the articulated leg section relative to the surgical table when the articulated leg section is articulated.

13. The shoulder surgery attachment of claim 12, further comprising a height gage, said height gage being configured to space the rail clamps relative to the pivot axis of the articulated leg section, thereby to position the attachment.

14. The shoulder surgery attachment of claim 12, in which the chair back assembly comprises a laterally adjustable base to which the cooperating second connectors are coupled to accommodate surgical tables of varying widths.

15. The shoulder surgery attachment of claim 12, wherein the cooperating second connectors are coupled to the chair back assembly to be selectively laterally adjustable to accommodate surgical tables of varying widths.

16. The shoulder surgery attachment of claim 15, wherein the chair back assembly comprises a laterally adjustable base, the second connectors being coupled to the laterally adjustable base.

17. The shoulder surgery attachment of claim 12, wherein the chair back assembly comprises a laterally adjustable telescoping base to adjustably position the second connectors to accommodate surgical tables of varying widths.

18. The shoulder surgery attachment of claim 12, wherein the chair back assembly comprises an opening configured to receive the patient's arm rearward of a plane defined by the patient's back.

19. The shoulder surgery attachment of claim 18, wherein the chair back assembly comprises a pair of openings each configured to receive one of the patient's arms rearward of a plane defined by the patient's back.

20. The shoulder surgery attachment of claim 18, comprising a side section provided over the opening and configured to support the patient's shoulder.

21. A shoulder surgery attachment for a surgical table having an articulated leg section with accessory attachment rails on opposite sides thereof, wherein the shoulder surgery attachment comprises:

a backboard;

a base positioned on one end of the backboard and comprising a member movable relative to the base;

first and second mounting connectors, the first connector fixedly attached to the base and the second connector fixedly attached to the movable member; and a pair of rail clamps configured to be coupled to the accessory attachment rails of the articulated leg section for movement therewith when the articulated leg section is articulated, each clamp configured to support one of the mounting connectors.

22. The shoulder surgery attachment of claim 21, wherein the base provides an opening in which the member moves telescopically to couple the shoulder surgery attachment to surgical tables of different widths.

23. The shoulder surgery attachment of claim 21, wherein the first and second mounting connectors are first and second mounting blades, each blade including a portion attached to the base and the movable member respectively, and each blade having an angularly-spaced blade portion that is coupled to an associated rail clamp.

24. The shoulder surgery attachment of claim 23, wherein each blade portion is angled relative to the backboard to provide a mechanical advantage when the leg section is raised with a patient resting against the backboard.

25. The shoulder surgery attachment of claim 21, wherein the chair back assembly comprises an opening configured to receive the patient's arm rearward of a plane defined by the patient's back.

26. The shoulder surgery attachment of claim 21, wherein the chair back assembly comprises a pair of openings each configured to receive one of the patient's arms rearward of the plane defined by the patient's back.

27. A shoulder surgery attachment for a surgical table having an articulated section with accessory attachment rails on opposite sides thereof; wherein the shoulder surgery attachment comprises:

a chair back assembly having a base on one end thereof;

a pair of mounting blades fixed on opposite sides of the base; and a pair of rail clamps configured to be coupled to the accessory attachment rails of the articulated section for movement therewith when the articulated section is articulated, and the rail clamps including mounting slots configured to receive free ends of the mounting blades.

28. The shoulder surgery attachment of claim 27, wherein the mounting blades are positioned outside the accessory attachment rails of the articulated section when the mounting blades are received in the mounting slots in the rail clamps.

29. A shoulder surgery attachment for a surgical table having an articulated section with accessory attachment rails on opposite sides thereof, the attachment comprising:

a rail clamp configured to be fastened to each of the attachment rails of the articulated section to provide a first connector at each side of the articulated section for movement therewith when the articulated section is articulated;

the rail clamps being positionable along the attachment rails; and a chair back assembly having at each of its sides a cooperating second connector fixedly coupled thereto, each second connector being releasably attachable to its corresponding first connector, whereby the chair back assembly is selectively adjustable with the articulated section relative to the surgical table when the articulated section is articulated.

30. A shoulder surgery attachment for a surgical table having an articulated section with accessory attachment rails on opposite sides thereof, wherein the shoulder surgery attachment comprises:

a backboard;

a base positioned on one end of the backboard and comprising a member movable relative to the base;

first and second mounting connectors, the first connector fixedly attached to the base and the second connector fixedly attached to the movable member; and a pair of rail clamps configured to be coupled to the accessory attachment rails of the articulated section for movement therewith when the articulated section is articulated, each clamp configured to support one of the mounting connectors.

* * * * *